United States Patent [19]

McCarthy

[11] 4,230,367

[45] Oct. 28, 1980

[54] METHOD OF OBTAINING OIL FROM OIL SHALE DEPOSITS

[75] Inventor: Harry E. McCarthy, Golden, Colo.

[73] Assignee: Science Applications, Inc., La Jolla, Calif.

[21] Appl. No.: 894,330

[22] Filed: Apr. 7, 1978

[51] Int. Cl.[3] ..... E21C 41/10

[52] U.S. Cl. ..... 299/2; 299/13; 299/19

[58] Field of Search ..... 299/13, 2, 4, 5, 19

[56] References Cited

U.S. PATENT DOCUMENTS

| | | | |
|---|---|---|---|
| 3,434,757 | 3/1969 | Prats | 299/13 X |
| 3,661,423 | 5/1972 | Garret | 299/2 |
| 3,951,456 | 4/1976 | Ridley | 299/2 |
| 4,017,119 | 4/1977 | Lewis | 299/13 |
| 4,043,598 | 8/1977 | French et al. | 299/13 |
| 4,149,595 | 4/1979 | Cha | 299/13 |
| 4,162,706 | 7/1979 | Cha | 299/2 |
| 4,167,291 | 9/1979 | Ridley . | |

OTHER PUBLICATIONS

"Oil Shale Mining and the Environment", Mining Engineering, Apr. 1978, pp. 360–363.

*Primary Examiner*—William F. Pate, III

*Attorney, Agent, or Firm*—Poms, Smith, Lande & Rose

[57] ABSTRACT

The present method involves the initial mining of horizontally extending layers of oil-rich or "kerogen phase continuous" shale. The oil-rich shale is brought to the surface where it is retorted in above-ground retorts of one of the known types. The leaner oil shale which is still "in situ" is then explosively fragmented into the voids created when the oil-rich shale was mined, and oil is obtained as the fragmented shale is ignited, in accordance with known horizontal type modified in situ oil shale retorting techniques.

10 Claims, 3 Drawing Figures

METHOD OF OBTAINING OIL FROM OIL SHALE DEPOSITS

FIELD OF THE INVENTION

This invention relates to oil shale retorting techniques.

BACKGROUND OF THE INVENTION

It has previously been proposed to create horizontal or vertical voids in oil shale and to fragment adjacent oil shale into these voids, and subsequently ignite the rubblized shale. Under limited combustion conditions, combustible product gases and oil resulting from decomposition of the organic kerogen contained in the oil shale is obtained in accordance with known techniques. This is known as modified in situ oil shale retorting.

The composition of oil shale may include calcium magnesium carbonite or dolomite, and the organic kerogen material. In relative lean oil shale, of the type which produces less than about 25 or 30 to 35 gallons of oil per ton of oil shale, the inorganic material is phase continuous and the kerogen material is isolated throughout the shale. This lean shale is relatively incompressible even at high temperatures. In the richer oil shale, however, the kerogen is phase continuous and the calcium magnesium carbonate molecules are spaced through the organic material.

In modified in situ oil shale operations, this richer oil shale has caused some problems. More specifically, with the organic material predominating, the rich oil shale, when heated, is compressible, and tends to flow and compact, with the effect of blocking the desired flow of air and other gases, and liquids, through the rubblized oil shale.

A principal object of the present invention is to avoid this undesired compression of the oil rich shale and the resultant blocking of the gas and liquid flow.

SUMMARY OF THE INVENTION

In accordance with the present invention it has been determined that oil shale deposits characteristically have layers of generally horizontally extending oil rich shale. By mining portions of one or more of these layers of oil-rich shale, voids are created in the shale deposit which are suitable for use in "horizontal slot type modified in situ oil shale retorting". More specifically, the lean shale deposits adjacent the resultant void are explosively fragemented into the horizontal void created when the portion of an oil-rich layer of shale is mined. Thereafter the rubblized shale is retorted in place in accordance with known techniques.

In the case of horizontal slot type modified in situ oil shale retorting, it is often desirable to prepare two or more horizontally extending voids overlying one another and spaced apart vertically by oil shale which is to be explosively fragmented into the overlying voids. In many cases two oil rich layers will be spaced apart so that the pair of spaced horizontally extending vois may be mined by removing overlying portions of the two oil rich layers. However, if this favorable geometry is not present, a second void may be mined in leaner oil shale overlying, or below, the mined section of rich oil shale.

This process has the advantage of removing the kerogen phase continuous oil shale, which tends to compress under elevated temperatures and block the in situ retorting process.

A collateral advantage of the present process is the high oil content of the shale which is physically brought to the surface of the earth. It is relatively expensive to bring this material to the surface of the earth so the high oil yield tends to defray some of these costs. Additionally, known retorting apparatus can readily and often preferably handle the oil-rich shale.

In accordance with a broad aspect of the invention, oil rich shale is excavated from a shale deposit, and retorted above ground, and remaining shale is explosively fragmented into the void, and retorted in situ.

Other objects, features and advantages will become apparent from a consideration of the following detailed description and from the accompanying drawings.

Detailed Description

Figure 1:
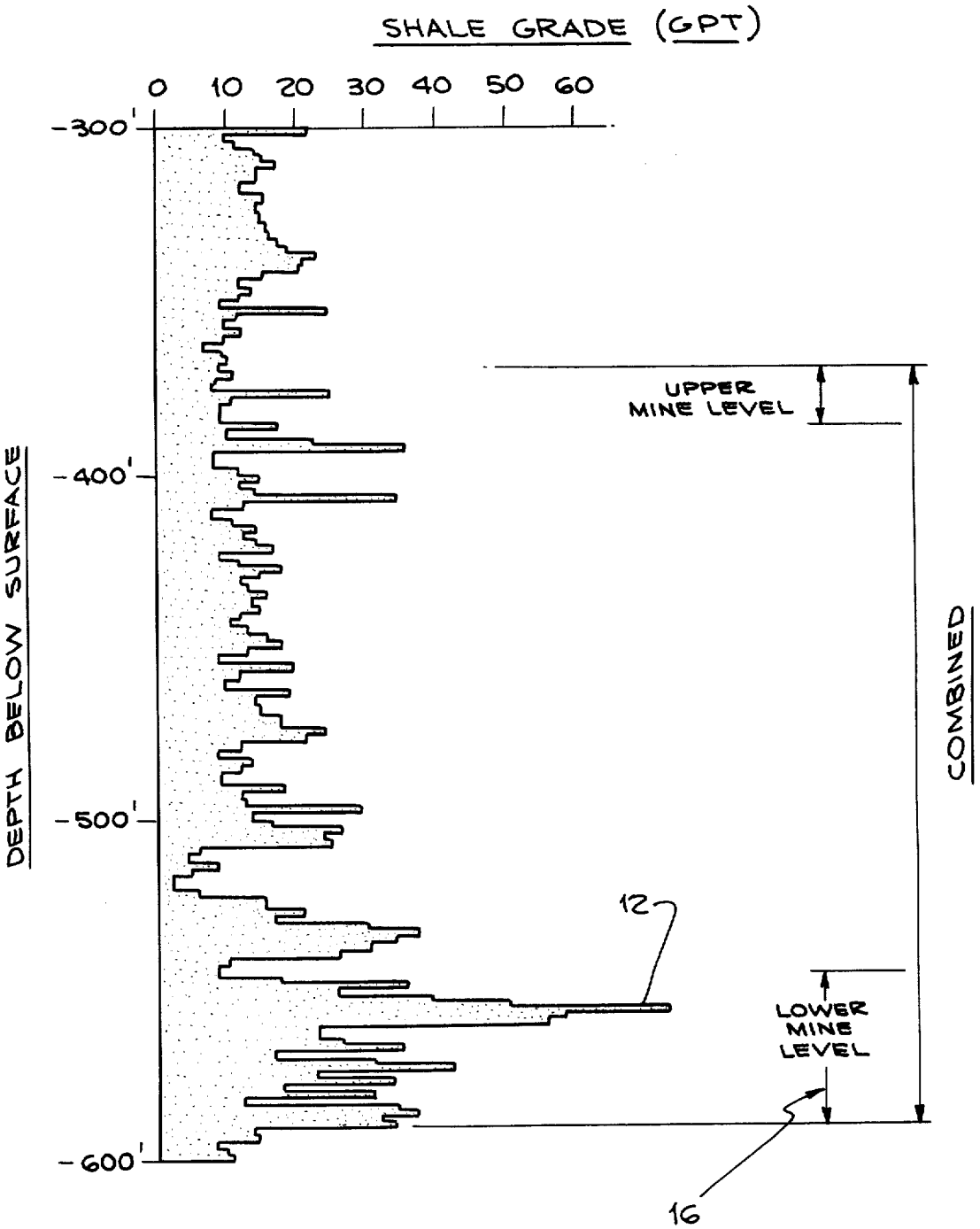
FIG. 1 is a graph showing oil shale grade, in gallons of oil per ton, plotted against the depth of the oil shale formation below the surface of the earth, and an indication of the zones to be mined, in accordance with the present invention.

Referring more particularly to the drawings, FIG. 1 is a graph indicating the richness of the oil shale in a particular oil shale deposit. The plot included in FIG. 1 was based on data taken from core hole samples every few feet at depths ranging from 300 feet to 600 feet below the surface of the ground. As can be observed in FIG. 1, most of the oil shale formation is relatively lean having an oil content in the order of 20 gallons per ton or less, down to about 520 or 530 feet. In the region from about 520 to 585 or 590 feet below the ground, however, the oil shale is relatively rich, with one sample testing to a level even above 70 gallons per ton. This peak in the characteristic is identified by reference numeral 12 in FIG. 1.

Figure 2:
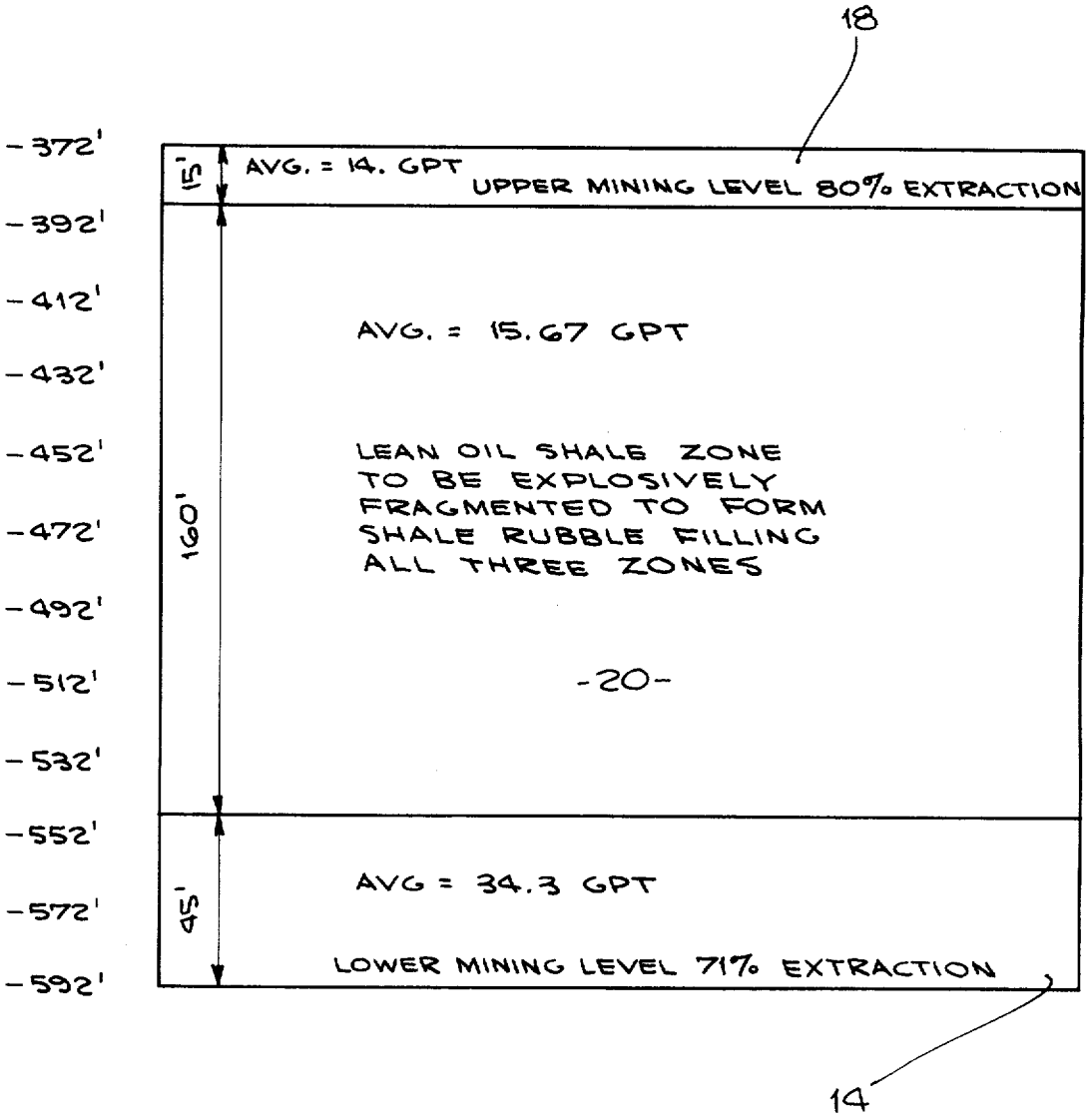
FIG. 2 is a diagrammatic showing of an oil shale formation, and the regions to be mined and explosively fragmented in accordance with the present invention.

FIG. 2 is a diagrammatic showing of the mining operation which is undertaken in order to carry out the present invention. More specifically, the initial step of the process of the present invention involves the mining out of an extended horizontal zone at a lower mining level designated by the reference numeral 14 in FIG. 2 and by the region 16 as shown in FIG. 1. This range extends from approximately 592 feet below the surface of the earth to approximately 547 feet below the surface of the earth with a height of this horizontal section which is excavated of approximately 45 feet. As indicated in the block 14 in FIG. 2, the average grade of the excavated shale from the lower section 14 is approximately 34.3 gallons per ton. It may also be noted that in the lower mining level 14 approximately 71% of the oil shale is extracted, with the remainder being left in place to form supporting pillars to carry the weight of the overlying shale formation and other overburden. This mining operation is conducted in accordance with conventional mining techniques.

Also shown in FIG. 2 is the upper mining level 18 and the intermediate shale oil structure 20 which is explosively fragmented at a later stage in the process to substantially fill the entire region including the previously mined zones 14 and 18. In view of the lesser amount of weight to be supported by the columns in the upper mining level 18, the percentage of extraction is 80%, somewhat higher than the 71% extraction in the lower mining level 14. The resultant reduced size of the pillars in the upper mining level 18 is in accordance with conventional mining practice.

Following the excavation of the upper and lower mining levels 18 and 14, the body of shale 20 between the upper and lower mining levels is explosively fragmented. This can be accomplished in accordance with any desired technique. One method is disclosed in U.S. Pat. No. 3,917,346, granted Nov. 4, 1975. Other techniques for blasting to a horizontal surface, and parameters which may be employed, are disclosed in a paper entitled, "Application of Cratering Characteristics to Conventional Blast Design", by Bruce B. Redpath. Copies of the paper are available from John A. Blume & Associates, Engineers, 130 Jessie Street, San Francisco, California 94105.

In general, for a commercial retort, the two mining levels 14 and 18, as shown in FIG. 2, might be of substantial extent, such as 200 feet by 200 feet. The overall height of the cavity in the oil shale formation, following the explosive fragmentation of the portion of the oil shale deposit designated 20 in FIG. 2, is approximately 219 feet. In general, it is desired that the height of the rubblized mass of oil shale to be retorted below ground has an elevation somewhat greater than the linear dimension of the horizontal zones which were previously mined. Thus, the 219 feet vertical extent of the rubblized shale is somewhat greater than the linear dimension of 200 feet which constitutes one side of the square area which was mined in the lower level 14, and also in the upper mining level 18. It is particularly to be noted that the dimensions of the rubblized body are not critical, although it is normally desired that the height should exceed the horizontal linear dimension. The height might very well be several times, such as three or four times the linear horizontal dimension of the mined zones. It is also understood, that, in the course of mining the upper and lower levels, additional access passageways would normally be provided in accordance with conventional mining techniques.

Following the extraction of the rich oil shale from the lower mining level 14, it is brought to the surface of the ground, and is retorted in conventional above-ground retorting apparatus to extract the oil, and gaseous products which are present in oil shale. These above-ground retorts are characteristically designed to retort the richer oil shales such as that which has been mined from the lower mining level 14; accordingly, it is conveniently and readily subject to such above-ground retorting.

Following rubblization of the portion 20 of the oil shale formation, the entire cavity including zones 14, 18 and 20, are substantially filled with oil shale rubble. Subsequently, in accordance with known techniques in the industry, the rubblized shale is ignited and oil and useful combustible gases are extracted. Normally, the flame front extents substantially horizontally across the rubblized oil shale, and travels either downwardly or upwardly, depending on the retorting process which is undertaken. There are many descriptions in the literature of modified in situ oil retorting, and reference is made to two additional related patents, Rex T. Ellington, U.S. Pat. No. 3,586,377, and Arthur E. Lewis, U.S. Pat. No. 4,017,119, granted Apr. 12, 1977. In addition to disclosing known shale oil retorting arrangements, the last-mentioned patent is of interest in disclosing the problem arising from plastic flow of rich rubblized oil shale, and the resultant clogging and blocking of the free flow of liquids and gases, which may result from such plastic flow. However, the solution proposed in U.S. Pat. No. 4,017,119 appears to involve the mixing of rich and lean oil shale rubble, and the provision of lean oil shale columns or zones extending through rich oil shale layers to provide improved permeability and flow through these zones of rich oil shale.

Figure 3:
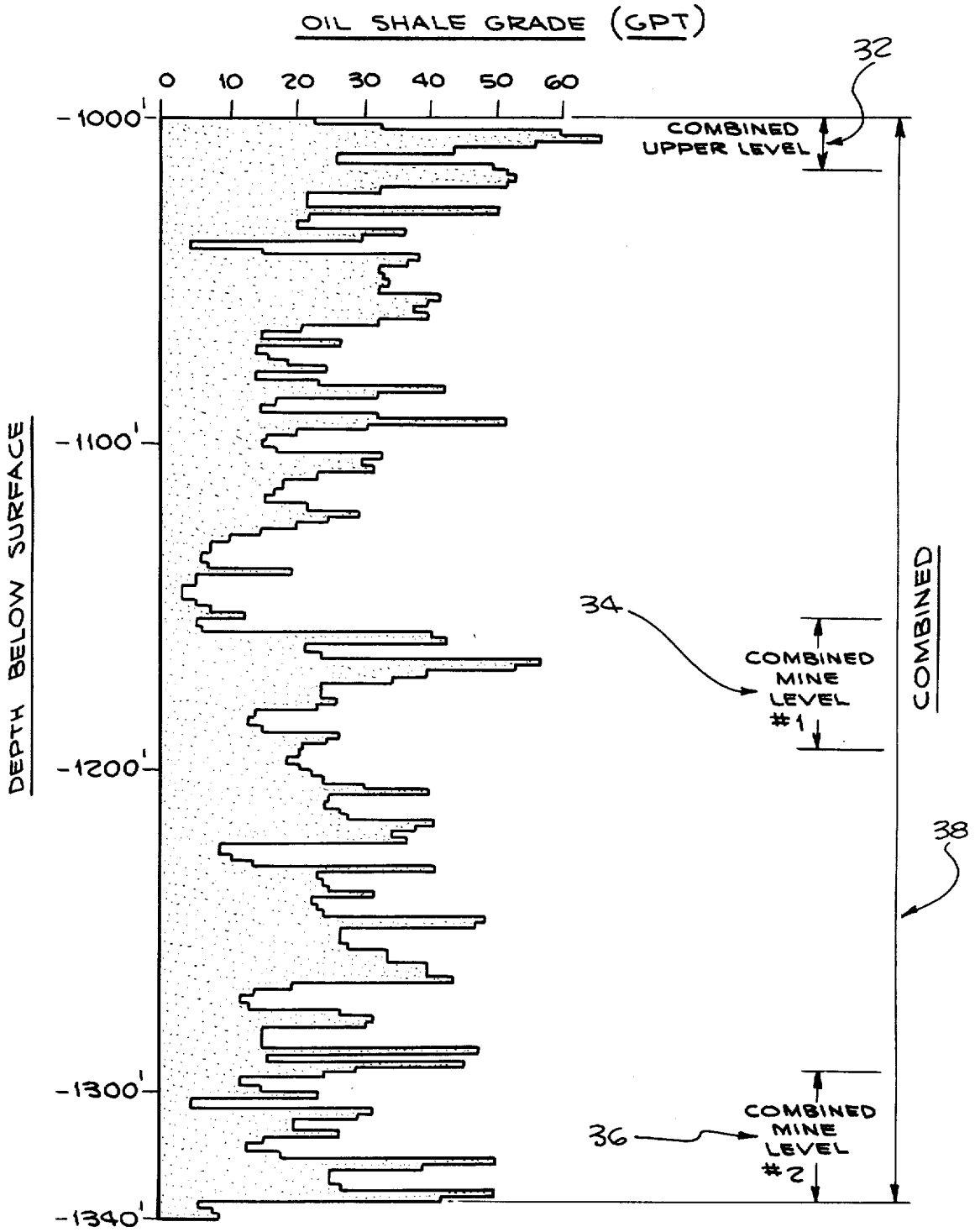
FIG. 3 is a diagram including a plot of oil shale grade versus depth below the surface, together with an indication of the regions to be excavated, in accordance with the present invention.

With reference to FIG. 3, an additional plot is provided showing the oil shale grade in gallons per ton plotted against depth below the surface of the ground. In FIG. 3, three horizontal zones for the mining of the rich oil shale layers are indicated by the reference numerals 32, 34, and 36. The overall height of the proposed modified in situ retort is shown by the extended arrow 38 which runs from approximately 1,000 feet below ground to 1330 to 1340 feet below ground. This makes a total distance of approximately 330 or 340 feet. Accordingly, the area of the horizontal zones to be mined could be approximately 300 feet by 300 feet, or, if a lesser total volume were desired, 200 feet by 200 feet, or even a lesser total area.

In the case of FIG. 3, it may be noted that each of the three mining levels is relatively rich oil shale, unlike the situations of FIGS. 1 and 2, where only the lower mining level was relatively rich oil shale. Accordingly, it is apparent that the principles of the present invention are applicable to oil shale formations where only one zone to be excavated is relatively rich oil shale, and also to situations where there are several spaced layers of relatively rich oil shale which may be readily mined, excavated, and retorted on the surface. Incidentally, in passing, it may be noted that the relatively lean oil shale from the upper mining level, in the case of FIG. 1, may be merely disposed of, rather than being retorted on the surface, if such disposition is appropriate.

It is noted in passing that oil shale beds normally extend horizontally and accordingly that the rich oil shale layers will normally extend in the desired horizontal direction. However, if the plane of the rich oil shale layer is tilted by a few degrees, the excavation could of course follow this tilt with no adverse effect. Also, in accordance with known techniques, suitable pillars may be retained as the horizontal layers of rich oil shale are excavated to support the overlying shale, or other material. In view of the fact that even the rich oil shale retains its mechanical strength at normal temperatures, there is no safety problem posed by this process.

In closing, it is to be understood that the present invention may be implemented in accordance with known mining technique and retorting processes, both above ground type retorting processes, and modified in situ retorting techniques. Also, minor modification of the process as described herein are clearly within the scope of the present invention.

What is claimed is:

1. A process for extracting oil and/or gas from an oil shale formation having at least one generally horizontally extending layer of oil-rich shale having a grade of at least 25 gallons of oil per ton, and being predominantly formed of kerogen phase continuous oil shale, with most of the rest of said formation being of a lesser grade, comprising the steps of:

excavating said generally horizontally extending layer of oil-rich shale;

excavating a second generally horizontally extending layer of oil shale in general vertical alignment with said first leaving pillars to support said formation, with the pillars comprising less than forty per cent of the volume of each of said layers;

explosively rubblizing the oil shale in said pillars and between said two sections; so that there are no regions within the rubblized mass having substantial volumes of kerogen phase continuous oil shale which could compress and block gas flow;

retorting the rubblized oil shale in situ to obtain oil therefrom; and retorting said excavated oil-rich shale above ground.

2. A process as defined in claim 1 wherein said excavating of said second horizontally extending section is also of oil-rich shale having a substantial content of phase continuous kerogen.

3. A process for extracting oil and/or gas from an oil shale formation having at least one generally horizontally extending layer of predominantly kerogen phase continuous oil-rich shale having a grade of at least 25 gallons of oil per ton, with most of the rest of said formation being of a lesser grade, comprising:

excavating one or more of said layers of oil-rich shale from said shale oil formation, said oil-rich shale having an oil content of at least 25 gallons of oil per ton;

explosively fragmenting a portion of the remaining oil shale into the resulting excavation to form a rubblized mass of oil shale having no regions having substantial volumes of kerogen phase continuous oil shale which could compress and block air flow;

retorting said excavated oil-rich shale above ground; and retorting said rubblized oil shale in situ.

4. A process as defined in claim 3 including excavating at least one substantially horizontally extending layer of oil-rich shale.

5. A process as defined in claim 3 including excavating a plurality of overlying substantially horizontally extending layers of oil-rich shale.

6. A process as defined in claim 3 including the formation of a mass of rubblized oil shale having a height substantially equal to or greater than its length or width in a horizontal plane.

7. A process for extracting oil and/or gas from oil shale comprising:

excavating oil-rich shale from a shale oil deposit, said oil-rich shale having an oil content of at least 25 gallons of oil per ton, and being formed of predominantly kerogen phase continuous shale, said excavating including the step of mining specially spaced horizontal layers of kerogen phase continuous oil shale to prelude the presence in the rubblized retort volume of any substantial contiguous volumes of kerogen phase continuous oil shale which could otherwise compact and block the retorting process;

explosively fragmenting a portion of the remaining oil shale into the resulting excavation to form a rubblized mass of oil shale;

retorting said excavated oil-rich shale aboveground; and retorting said rubblized oil shale in situ.

8. A process for extracting oil and/or gas from an oil shale formation which is made up principally of oil shale having phase continuous inorganic material, and having at least two spaced substantially horizontally extending layers or strata of kerogen phase continuous oil shale, comprising the steps of:

excavating oil-rich shale from a shale oil deposit, said oil-rich shale having an oil content of at least 25 gallons of oil per ton, said excavating including the step of mining said spaced substantially horizontal layers of kerogen phase continuous oil shale, to preclude the presence in the rubblized retort volume of any substantial contiguous volumes of kerogen phase continuous oil shale which could otherwise compact and block the retorting process;

leaving pillars to support said formation, with the pillars constituting less than thirty-five per cent of the volume of each of the excavated layers;

explosively fragmenting said pillars and a portion of the remaining oil shale formation into the resulting excavation to form a rubblized mass of oil shale; and retorting said rubblized oil shale in situ.

9. A process for extracting oil and/or gas from an oil shale formation having at least one generally horizontally extending layer of oil-rich shale having a grade of at least 25 gallons of oil per ton, and being predominantly formed of kerogen phase continuous oil shale, with most of the rest of said formation being of a lesser grade, comprising the steps of:

excavating more than sixty-five percent of said generally horizontally extending layer of oil-rich shale;

excavating a second generally horizontally extending layer of oil shale in general vertical alignment with said first section;

leaving pillars to support said formation, with the pillars comprising less than thirty-five percent of the volume of each of said layers;

explosively rubblizing the oil shale in said pillars and between said two sections; so that there are no regions within the rubblized mass having substantial volumes of kerogen phase continuous oil shale which could compress and block gas flow, and retorting the rubblized oil shale in situ to obtain oil therefrom.

10. A process for extracting oil and/or gas from an oil shale formation having at least one generally horizontally extending layer of oil-rich shale having a grade of at least 25 gallons of oil per ton, and being predominantly formed of kerogen phase continuous oil shale, with most of the rest of said formation being of a lesser grade, comprising the steps of:

excavating more than sixty-five percent of said generally horizontally extending layer of oil-rich shale;

excavating more than sixty-five percent of a second generally horizontally extending layer of oil shale in general vertical alignment with said first section, said second section also including substantial quantities of kerogen phase continuous oil shale;

leaving pillars to support said formation, with the pillars comprising less than thirty-five percent of the volume of each of said layers;

explosively rubblizing the oil shale in said pillars and between said two sections; so that there are no regions within the rubblized mass having substantial volumes of kerogen phase continuous oil shale which could compress and block gas flow, and retorting the rubblized oil shale in situ to obtain oil therefrom.

* * * * *